US006323823B1

(12) United States Patent
Wong et al.

(10) Patent No.: US 6,323,823 B1
(45) Date of Patent: Nov. 27, 2001

(54) BASE STATION CLUSTERED ADAPTIVE ANTENNA ARRAY

(75) Inventors: Piu Bill Wong, Monte Sereno; Shimon B. Scherzer, Sunnyvale, both of CA (US)

(73) Assignee: Metawave Communications Corporation, Redmond, CA (US)

( * ) Notice: Subject to any disclaimer, the term of this patent is extended or adjusted under 35 U.S.C. 154(b) by 0 days.

(21) Appl. No.: 09/618,088

(22) Filed: Jul. 17, 2000

(51) Int. Cl.[7] ..... H01Q 21/00
(52) U.S. Cl. ..... 343/844; 343/872; 343/890
(58) Field of Search ..... 343/844, 853, 343/872, 890, 891, 892, 893

(56) References Cited

U.S. PATENT DOCUMENTS 5,832,389 * 11/1998 Dent ..... 455/562
5,872,547 * 2/1999 Martek ..... 343/815
5,969,689 * 10/1999 Martek et al. ..... 343/758
6,026,627 * 2/2000 Moore ..... 52/651.02
6,088,003 * 7/2000 Bassirat ..... 343/890

* cited by examiner

*Primary Examiner*—Tho Phan
(74) *Attorney, Agent, or Firm*—Fulbright & Jaworski L.L.P.

(57) ABSTRACT

A base station clustered adaptive antenna array includes a plurality of clusters of antenna elements. Each cluster is spaced away from an adjacent cluster by a first predetermined spacing related to receive-mode beamforming and includes a plurality of transmit-receive antenna elements. Each element within the cluster is spaced away from an adjacent element by a second predetermined spacing related to transmit-mode beamforming. In order to reduce the visual impact of the antenna array, each cluster is included within a single exterior housing or radome. A medial receive-only antenna element may be provided between adjacent clusters to enhance beamforming for reverse link reception.

20 Claims, 6 Drawing Sheets

FIG. 2F
(PRIOR ART)
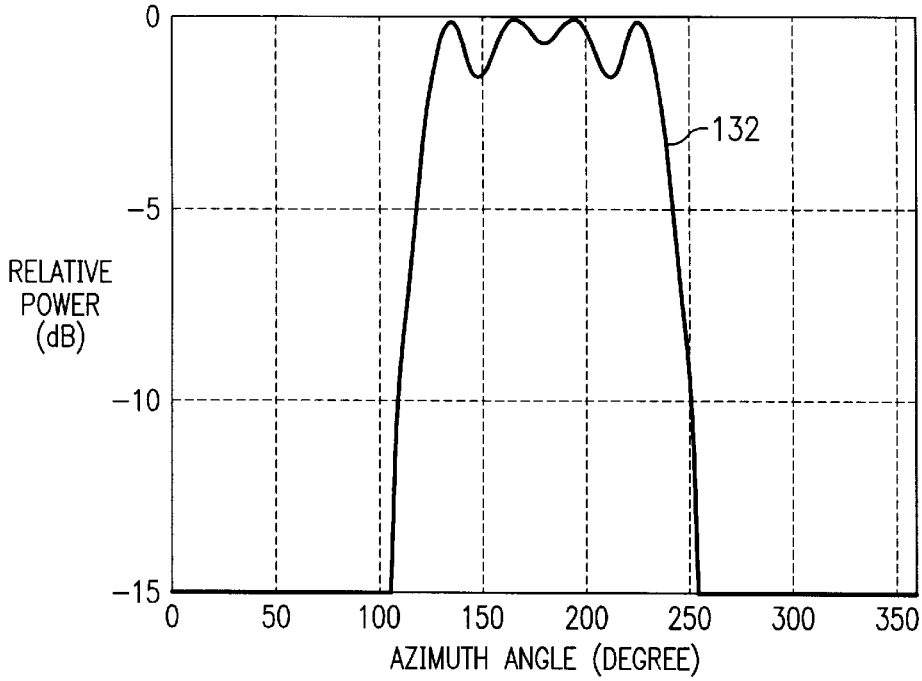
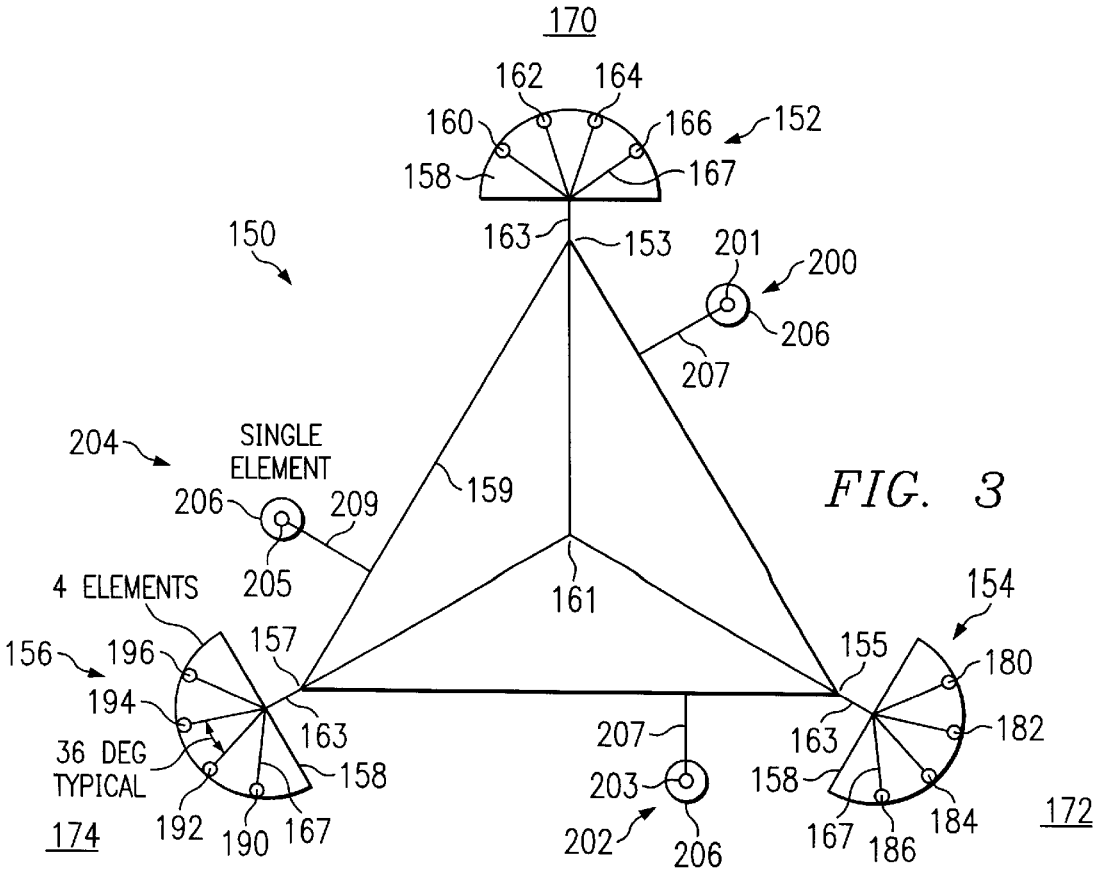
FIG. 3

BASE STATION CLUSTERED ADAPTIVE ANTENNA ARRAY

BACKGROUND

1. Field of Invention

The present invention relates to wireless information communications systems. More particularly, the present invention relates to an adaptive antenna array of a base station formed as a plurality of spaced apart clusters of antenna elements lying generally within a common horizontal plane.

2. Related Art

Wireless data and voice communications services are proliferating throughout the world. One popular service is the so-called "cellular" telephone service. In cellular telephone service, service areas are divided up into "cells", where each cell covers a specific geographical area and services mobile units located in, or passing through, the service area. Typically, radio frequencies are used in the ultra high frequency spectrum, and more typically in the 800 MHz or higher frequency range. The nature of radio wave propagation at these relatively short wavelengths limits the maximum effective distance between the mobile and the base, frequently to several miles. This propagation limit enables reuse of the same frequencies or bands within non-adjacent cells of the cellular network. Since the service range of each base station is limited to a radius of e.g. several miles, it is necessary to provide a number of base stations within a service area in order to provide effective wireless service throughout the area.

One known way to increase the number of mobile stations that may be served within a cell is to divide the cell into sectors, such as three sectors, spaced apart by 120° about the compass rose. In such an arrangement, each sector is provided with its own 120°-wide transmit beam from the base station.

Further increase in the number of mobile stations that may be simultaneously served within a cell or sector is to employ base station antenna arrays having plural elements. Embedding adaptive antenna array technology into the existing cellular telephone infrastructure potentially provides very significant capacity increases. This technology offers the ability to eliminate same cell interference for mobile stations being served simultaneously. It offers the prospect of a reduction of inter-cell interference. It also increases the signal-to-noise ratio of a particular mobile station being served and therefore enables an increase in user data rate. These benefits and advantages result in either higher data throughputs, or the ability to service more mobile stations simultaneously, within a given cell or service infrastructure. With spatially separated elements, beamforming becomes practical for both transmit and receive modes. Focusing radiant energy in the direction of a mobile station reduces the amount of overall power needed to be generated by the base station in order to maintain a given service quality. Antenna array technology can be used to focus power coming from the mobile station to the base station via a reverse link or an uplink, as well as from the base station to the mobile station via a forward link or downlink.

Usually, during transmit mode, a wide transmit beam is desired so that the transmit beam, and its associated pilot, reaches all of the mobiles within the service area or sector, since the base station does not initially know where any particular mobile would be within that area. In transmit mode, relatively wide transmit beams may be formed by using phased antenna elements of an array wherein the elements are spaced relatively closely apart, with spacing between adjacent elements being on the order of between one half and one wavelength at the transmit frequencies. At the cellular frequency bands in the range of 800 MHz, one wavelength equals 0.375 meters, or 14.775 inches, with one half wavelength being half of these linear values. After a particular mobile station is located within the service area of the base station, narrower transmit beams may be employed to divide and concentrate limited base station power among all of the mobile stations being served simultaneously.

In base station receive mode, very narrow beams are highly desirable in order to provide multiple beam diversities and concentrate the signal energy from a particular one of the mobiles operating within a particular one of the available service channels and to exclude or reduce signal energies from other mobiles within the same service area using other ones of the available service channels. Beamforming narrow beams in receive mode requires that the phased receive antenna elements be placed relatively farther apart than the transmit elements. Phased adjacent receive elements are most preferably placed apart by approximately three wavelengths. At 800 MHz, three wavelengths equals 1.125 meters or 44.325 inches. From these desirable spacings, it becomes immediately apparent that base station receive mode antenna arrays may become relatively quite large and visually noticeable at the base station locations within the neighborhoods of the various cellular communications service areas. Since the highest service requirements occur in the most highly populated areas, large base station antenna arrays become the subject of observation and complaint by a relatively large part of the population as a whole. One popular misconception held by some members of the public at large is that the larger the antenna array, the greater will be the exposure level to electromagnetic radiation at the vicinity of the array. Also, members of the public may object to what is perceived to be a negative visual impact or blight upon the environment of a particular neighborhood presented by large antenna arrays providing wireless communications services.

For example, FIG. 1 shows a conventional three-sector cellular antenna array 10 mounted at desired elevation above ambient terrain upon a triangular support tower 12. A triangular support tower is frequently employed in wireless communications because it provides considerable strength with minimal material and takes advantage of the inherent strength of three-leg, triangle geometry in the horizontal plane and triangle bracing in the vertical planes of each tower face. The antenna array 10 is designed to serve three service sectors 14, 16 and 18. For sector 14, a transmit-receive element 20 is located at one corner of the tower 12, and a receive-only element 22 is located at another corner of the tower 12 at a spacing selected to enable effective diversity reception. The antenna elements 20 and 22 are enclosed and protected from the weather by radomes 24, typically formed of radio-wave-transparent material such as molded fiberglass or plastic.

The transmit-receive element 20 is adapted to broadcast a service beam throughout the sector 14, and the element 20 may also be simultaneously used to receive at a different frequency or band with the inclusion of conventionally available duplexer filter technology, or may be used in a time division multiplex arrangement, with one time increment operating in transmit mode and a next time increment operating in receive mode. The receive mode element 22 provides spatial diversity reception for signals arising within the service sector 14. Similarly, the service sector 16 includes transmit-receive element 26 and receive-only element 28, and the service sector 18 includes transmit-receive element 30 and receive-only element 32. While the arrangement of antenna array 10 in FIG. 1 enables some beamforming, very narrow receive-mode beams with additional array gains of about 5 dB with respect to a single antenna element are not achievable with only two spatially diverse receive antenna elements.

Narrow beamforming creating very narrow beams with high antenna array gains at the base station for both receive and transmit modes typically requires more antenna elements. FIG. 2A presents a more recently proposed antenna array for wireless cellular communications service which employs a relatively large multi-element receive antenna array 50 and a relatively small multi-element transmit antenna array 52. While FIG. 2A shows the transmit array 52 to the side of the receive array 50, the transmit array 52 may also be mounted concentrically with the receive array 50 on a tower, provided that a different elevation is used to prevent the transmit array 52 from being blocked by the receive array 50.

The receive array 50 includes e.g. 16 separate receive elements 54, 56, 58, 60, 62, 64, 66, 68, 70, 72, 74, 76, 78, 80, 82, and 84 disposed along a circular locus formed by a support ring 85. The spacing between adjacent elements of the receive array 50 is preferably on the order of three wavelengths (3λ). Each element 54–84 is provided with its own radome 86. As shown in the rectangular coordinate graph of FIG. 2B, the receive array 50 is capable of forming a relatively very narrow receive beam 88 in a particular direction within the service area relative to the array 50 with nearest adjacent side lobes 89 separated in phase from the beam 88 by approximately 22°. The receive array antenna beam pattern shown directed to 180° shown in FIG. 2B is a typical beam pattern that can be formed using the receive array 50. The rectangular coordinate graph of FIG. 2C shows a receive array beam pattern directed to 90° and represents a typical beam pattern that can be formed using the receive array 50. In the graph of FIG. 2C, the nearest adjacent side lobes 89 are shown separated in phase from the main lobe 88 by approximately 22°.

The transmit array 52 includes e.g. 16 separate transmit elements 90, 92, 94, 96, 98, 100, 102, 104, 106, 108, 110, 112, 114, 116, 118 and 120, also disposed about a circular locus formed by a support ring 121. The spacing between adjacent elements of the transmit array is preferably on the order of one-half wavelength (½λ) to one wavelength (1λ). Because of the relatively close spacing, all of the transmit elements 90–120 may be enclosed within a common radome 122. As previously noted, the transmit array 52 may be located to the side of the receive array 50, or preferably above or below the receive array 50 in a concentric arrangement shown in dashed outline relative to the receive array 50 in FIG. 2A. The transmit antenna array 52 is arranged and operated to provide simultaneous transmit (downlink) signals for e.g. three sectors 124, 126 and 128.

FIG. 2D depicts a typical, relatively narrow transmit beam pattern having a main lobe 130 focused at a direction of 180° with a maximum antenna gain (a main lobe 3 dB beamwidth at 17°, and side lobes 131 separated by 100°) formed using the transmit array 52 of FIG. 2A. FIG. 2E depicts the relatively narrow transmit beam pattern formed by the transmit array 52 at a direction of 90°. FIG. 2F shows a typical relatively wide transmit beam having a single lobe 132 directed at 180° which may be formed by the transmit array 52. The beam of FIG. 2F has a 3 dB beamwidth of 120°, and is typically used for transmitting common pilot and broadcast channel information for the particular sector being serviced. With the transmit array 52 shown in FIG. 2A, each sector can be provided with a relatively narrow transmit beam 130 (FIG. 2E) and a relatively wide transmit beam 132 (FIG. 2F). The receive array 50 provides receive-mode (uplink) beamforming for all three sectors 124, 126 and 128, in the present example.

Spatial diversity multiple access methods employing adaptive antenna arrays are described in U.S. Pat. Nos. 5,471,647 and 5,634,199 to Gerlach et al., and methods and structures for providing rapid beamforming for both uplink and downlink channels using adaptive antenna arrays are described in commonly assigned U.S. patent application Ser. No. 08/929,638 to Scherzer, entitled "Practical Space-Time Radio Method for CDMA Communication Capacity Enhancement", all of which are incorporated herein by reference in their entirety.

While a number of benefits including increased service capacity can be realized by using adaptive antenna arrays, such arrays have heretofore been objected to by land use planning regulators because of concerns relating to perceived electromagnetic radiation hazards and concerns relating to objectionable or negative visual impact. Thus, an unsolved need has remained for a multi-element antenna array that provides such benefits while presenting a reduced visual impact at the base station location.

SUMMARY

A general object of the present invention is to provide a base station multi-element adaptive antenna array which manifests a reduced visual impact at the base station location while enabling effective forward link and reverse link beam forming.

Another object of the present invention is to group multiple receive-transmit antenna elements of an adaptive antenna array into a plurality of spatially separated clusters and to provide a single exterior housing or radome for each cluster.

A further object of the present invention is to provide additional receive only antenna elements medially between adjacent clusters of antenna elements of an adaptive antenna array.

In accordance with principles of the present invention, a base station clustered adaptive antenna array includes a plurality of clusters of antenna elements. Each cluster is spaced away from an adjacent cluster by a first predetermined spacing related to receive-mode beamforming. One such first spacing is equal to approximately ten wavelengths of the receive frequency or band. Each cluster includes a plurality (e.g., four) of transmit-receive antenna elements. Each element within the cluster is spaced away from an adjacent element by a second predetermined spacing related to transmit-mode beamforming. One such second spacing is equal to approximately between one-half and one wavelength of the transmit frequency or band. In order to reduce the visual impact of the antenna array, each cluster, in one embodiment, is included within a single exterior housing or radome. In one embodiment, the clustered adaptive antenna array includes three clusters mounted to corners of a support structure supporting a generally triangular frame with horizontal side dimensions approximating at least the first predetermined spacing of ten wavelengths of the receive frequency or band in one embodiment. The support frame may be an integral part of a triangular tower, or it may be a frame mounted to and supported at operational elevation by any suitable tower or structure, whether of triangular, circular, or other suitable cross-sectional geometry.

In accordance with a related aspect of the present invention, the clustered adaptive antenna array may include at least one receive antenna pod mounted medially between an adjacent pair of the plurality of clusters of antenna elements. In one embodiment of the triangular support tower, three medial receive antenna pods are provided, with a receive antenna pod being mounted medially between adjacent ones of the three clusters of antenna elements within a horizontal plane including the clusters.

The present invention will be more fully understood when taken in light of the following detailed description taken together with the accompanying drawings.

BRIEF DESCRIPTION OF THE DRAWINGS

FIG. 2F shows a typical transmit beam pattern having an effective 120° width that can be formed using the circular transmit array of FIG. 2A;

FIG. 3 is a top plan view of a base station clustered adaptive antenna array in accordance with one embodiment of the present invention;

Use of the same or similar reference numbers in different figures indicates same or like elements.

DETAILED DESCRIPTION OF THE PREFERRED EMBODIMENTS

Figure 1:
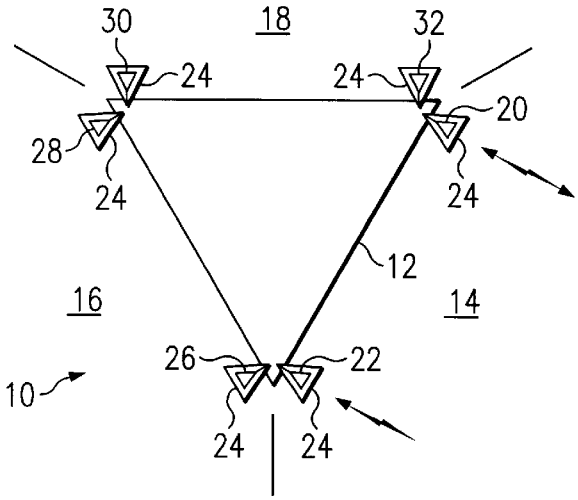
FIG. 1 (PRIOR ART)
FIG. 1 is a top plan view of a known cellular telephone base station antenna array serving three sectors of a service cell.
Figure 2A:
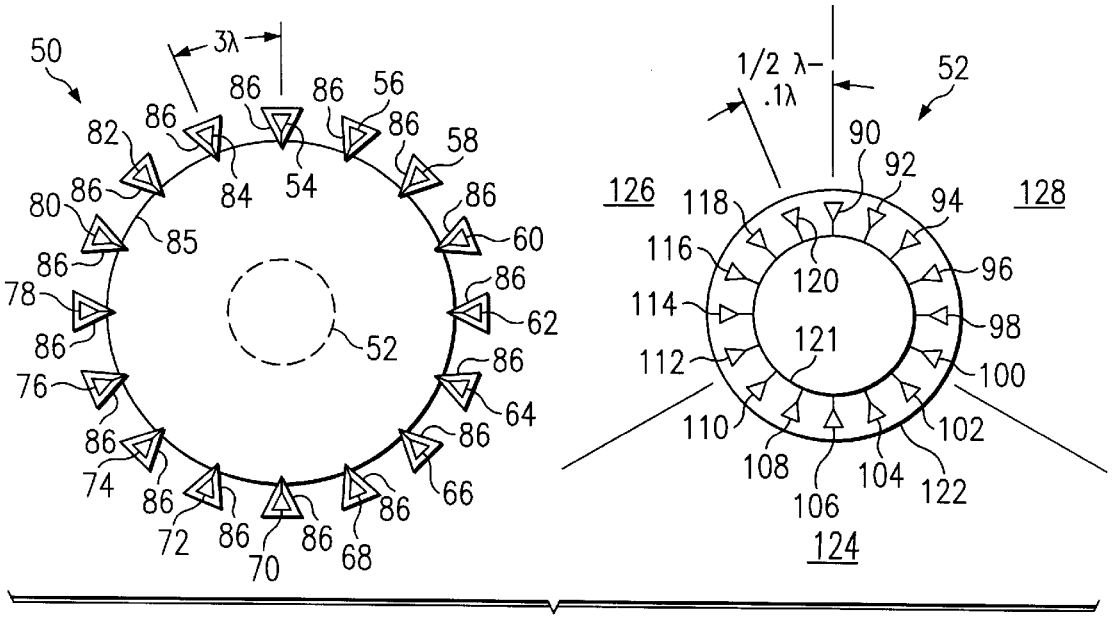
FIG. 2A (PRIOR ART)
FIG. 2A is a top plan view of a known multi-element circular receive array and a multi-element circular transmit array providing beamforming for receive mode (uplink) and transmit mode (downlink) base station communications within a service cell.
Figure 2B:
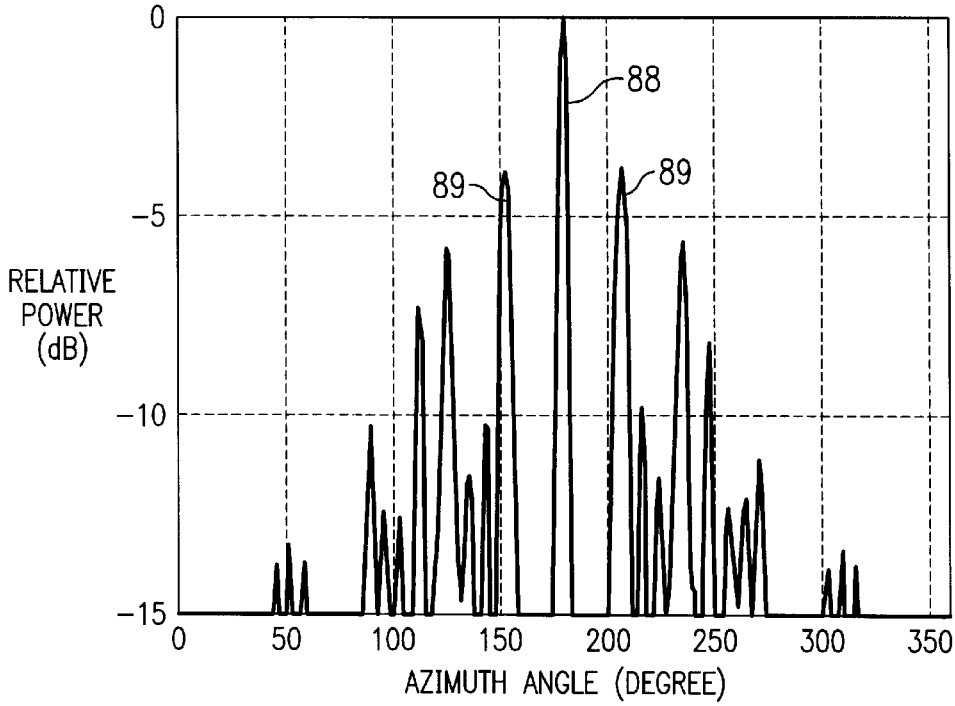
FIG. 2B (PRIOR ART)
FIG. 2B depicts a typical receive beam pattern of the receive array of FIG. 2A at a direction of 180°.
Figure 2C:
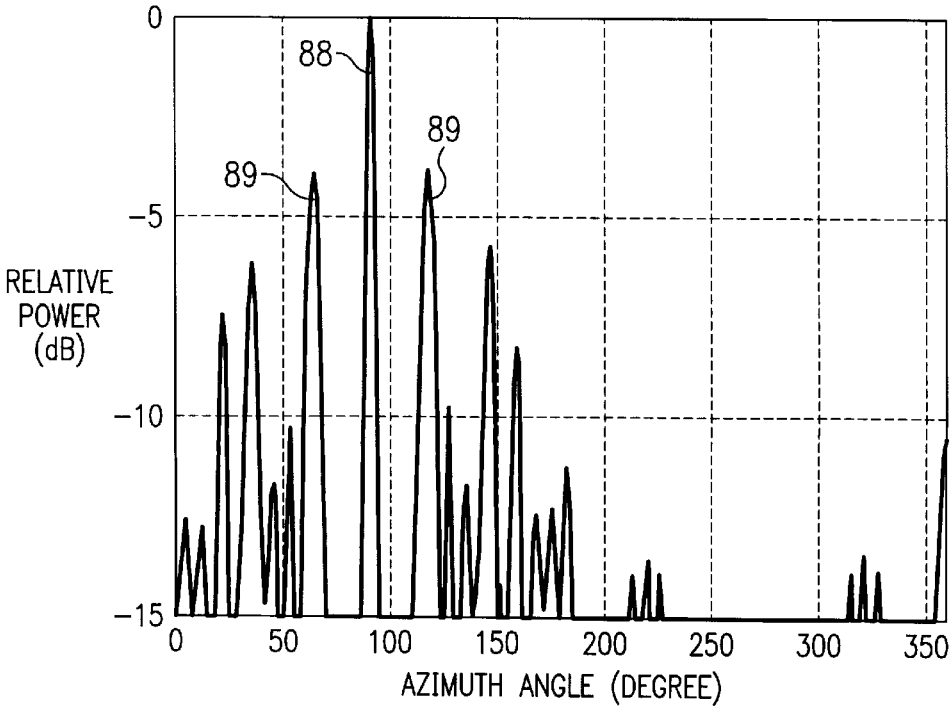
FIG. 2C (PRIOR ART)
FIG. 2C shows a typical receive beam pattern of the receive array of FIG. 2A at a direction of 90°.
Figure 2D:
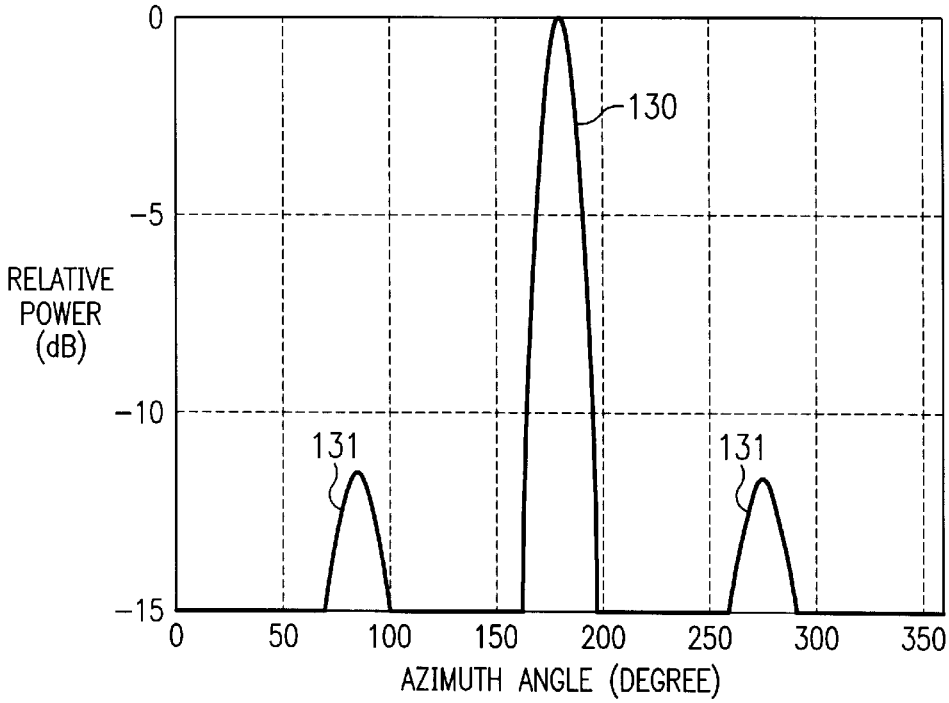
FIG. 2D (PRIOR ART)
FIG. 2D shows a typical transmit beam pattern with a maximum gain that can be formed using the circular transmit array of FIG. 2A focused at a direction of 180°.
Figure 2E:
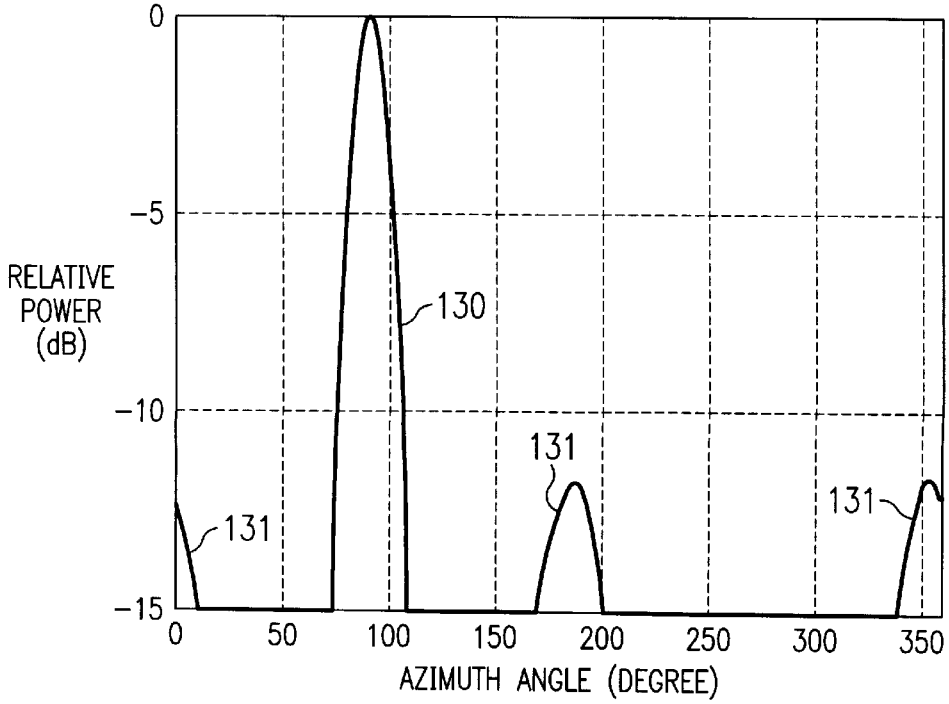
FIG. 2E (PRIOR ART)
FIG. 2E shows a typical transmit beam pattern with maximum gain using the circular transmit array of FIG. 2A focused at a direction of 90°.

FIG. 3 shows a top view of a base station clustered adaptive antenna array 150 in accordance with one embodiment of the present invention. The array 150 may be mounted to and supported at a useful service height by a conventional support structure, such as a triangular metal tower 12 of the type illustrated in FIG. 1. In this embodiment, the antenna array 150 is intended for use within the 1.9 GHz cellular telephone service. However, the principles of the present invention also apply to other land mobile wireless services and bands.

As shown in FIG. 3, the antenna array 150 includes three clusters 152, 154 and 156 of antenna elements lying generally within a common horizontal plane parallel to the surface of the earth. Each cluster is located at a corner of a triangular support structure 159. Thus, in the present illustration, array cluster 152 is located at a corner 153, array cluster 154 is located at a corner 155, and array cluster 156 is located at a corner 157. The antenna support structure 159 may be coextensive with a triangular tower, or it may be attached to, or extend from, another suitable support, such as a cylindrical column tower, for example. Each cluster 152, 154 and 156 can include a single radome enclosure 158 of radio-transparent material. The tower 12, the support structure 159 and each radome enclosure 158 may be imparted with a dull color having a hue and tone selected to blend in with the environment, thereby minimizing visual impact of the antenna array 150 at the vicinity of the base station and tower 12.

Each cluster may be mounted on an extension arm 163 which extends from each corner of the support structure 159 for a predetermined distance, to position each cluster outwardly from a center 161 of the support structure by a predetermined amount, such as approximately 78 cm. The length of each extension arm 163 is adjustable, in one embodiment, over a range of −15 cm to +30 cm relative to the center 161.

Multiple closely spaced antenna elements are provided within each cluster. For example, in cluster 152, four transmit-receive antenna elements 160, 162, 164 and 166 are provided. Adjacent ones of the elements 160, 162, 164 and 166 are angled apart from the extension arm by a mounting arm 167 in order to achieve a desired transmit array spacing of between one half wavelength and one wavelength at the operating frequency or band. In one embodiment, the length of the mounting arm 167 is approximately 15 cm and enables a −5 cm to +10 cm radial adjustment at the distal end of arm 163. The angular spacing of adjacent receive-transmit elements within each cluster 152, 154, 156 is approximately 36° in one embodiment. In this manner, a relatively broad transmit (forward link) beam, as well as a relatively narrow transmit (forward link) beam may be transmitted to a service sector 170, there being three 120° sectors 170, 172, and 174 served by the antenna array 150.

As shown in FIG. 3, antenna cluster 154 includes four transmit-receive antenna elements 180, 182, 184, and 186 and provides wide/narrow beam forward link service to mobile stations in the sector 172. Antenna cluster 156 includes four transmit-receive antenna elements 190, 192, 194, 196 and provides wide/narrow beam forward link service to mobile stations in the sector 174.

Figure 4:
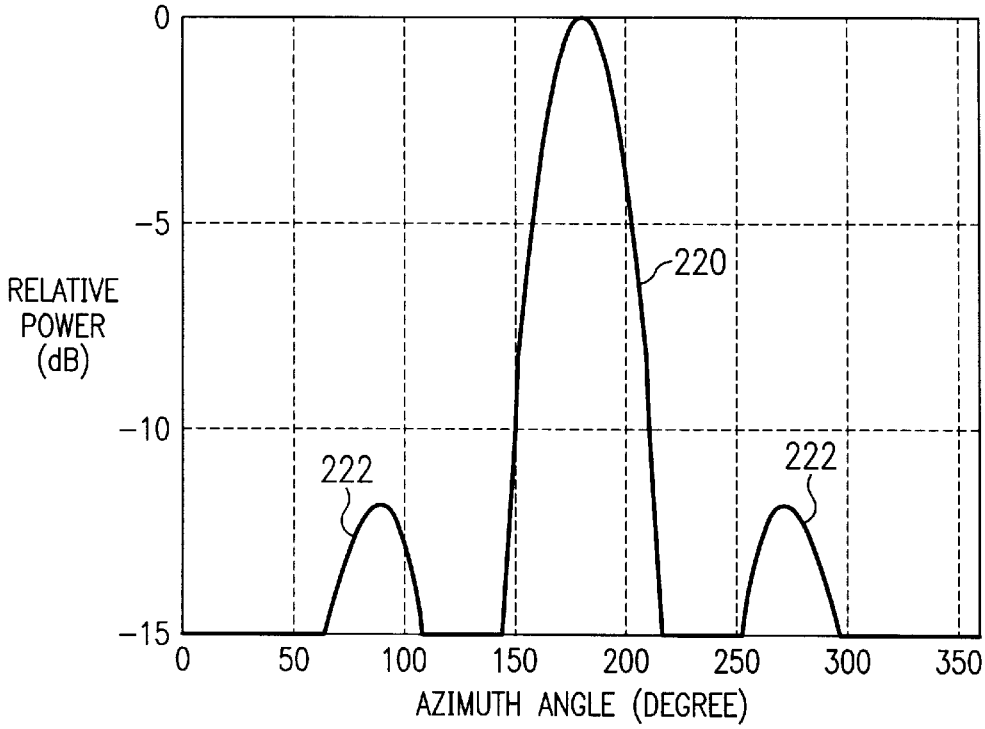
FIG. 4 is a rectangular coordinate graph that depicts a relatively narrow forward link (transmit) beam pattern formed by one of the antenna clusters of the clustered adaptive array in FIG. 3, at a direction of 180°.
Figure 5:
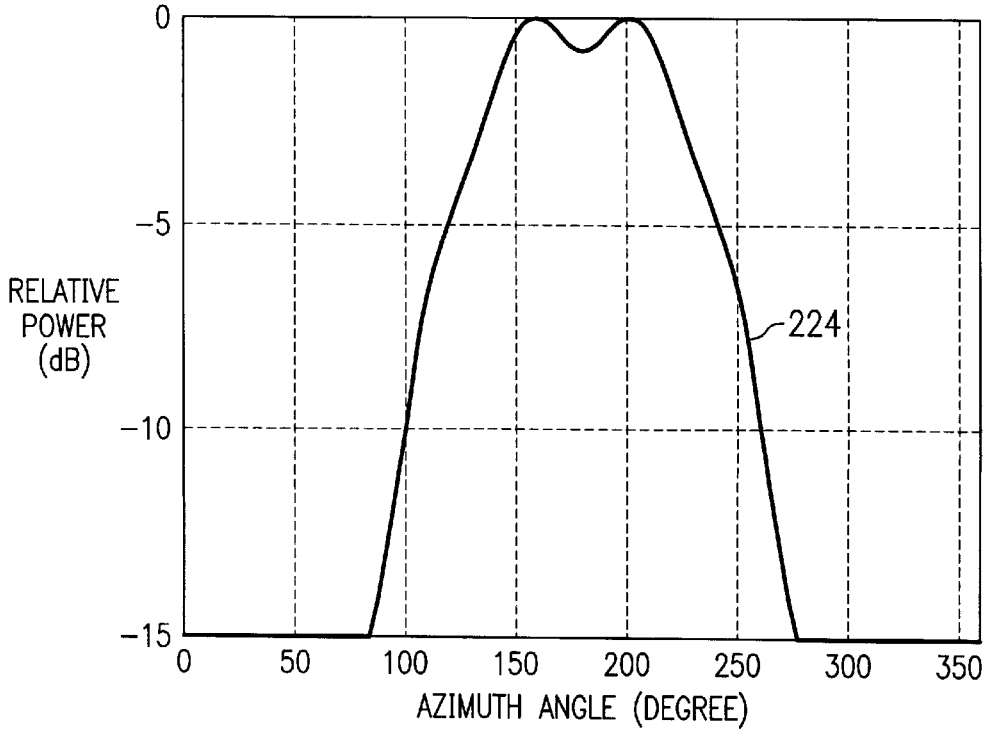
FIG. 5 depicts a relatively wide forward link beam pattern formed by one of the antenna clusters of the array in FIG. 3, at a direction of 180°.

FIG. 4 depicts a relatively narrow forward link beam pattern comprising a main lobe 220 directed to 180°, and having side lobes 222 at approximately ±90° formed by one of the clusters 152, 154, or 156. The main lobe 220 has a 3-dB beamwidth of 35°. The relatively narrow beam pattern of FIG. 4 is generally used for forward link traffic data transmissions. FIG. 5 graphs a relatively wide antenna beam pattern which may be formed by each one of the clusters 152, 154, 156. The beam pattern of FIG. 5 includes a single lobe 224 shown directed at 180° and having a 3-dB beamwidth of 100°. The relatively wide beam pattern of FIG. 5 is generally used for forward link common pilot and broadcast channel transmissions.

In receive (reverse link) mode, all of the antenna elements 160, 162, 164, 166, 180, 182, 184, 186, 190, 192, 194 and 196 are used. Since there are three antenna clusters 152, 154, and 156 in this example, narrow reverse link beamforming can be achieved by taking advantage of the spatial separation of the three clusters 152, 154, and 156.

Referring back to FIG. 3, further improvements in reverse link beamforming may be realized by adding single-receive element pods 200, 202 and 204 between the array clusters 152–154, 154–156, and 156–152, respectively, within the common horizontal plane of the array 150. The pod 200 includes a receive element 201, the pod 202 includes a receive element 203, and the pod 204 includes a receive element 205. These antenna elements can be of the same type as used in the array clusters. Each pod 200, 202, and 204 is positionally mounted to the support structure 159 by a support arm 207. In one embodiment, each support arm 207 is about 17 cm long. Each support arm 207 is offset from a center of a leg of the structure 159, e.g., by approximately 20 cm, there being a range of adjustment of ±25 cm from the center of the leg in one embodiment. In this arrangement, one of the elements of each of the clusters 152, 154 and 156 becomes a transmit only element, and its receive function is redirected to a respective one of the medial receive elements 201, 203 and 205. Small, visually minimized radomes 206 are used to enclose the medial receive elements 201, 203 and 205, thereby protecting such element from exposure to the external ambient weather and atmospheric conditions. These radomes 206 may be provided with a color or finish treatment consistent with that applied to the radomes 158 and support structure 159 in order to minimize visual impact of the antenna array 150.

Figure 6:
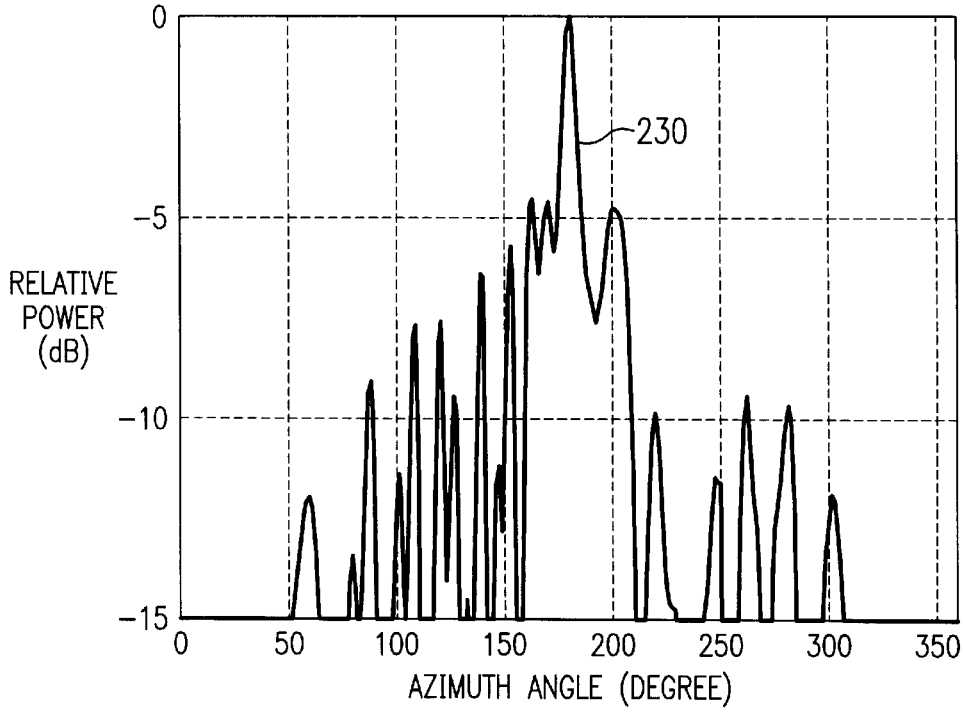
FIG. 6 depicts a relatively narrow reverse link (receive) beam pattern formed by the clustered adaptive array including medial receive elements shown in FIG. 3, focused at a direction of 180°.
Figure 7:
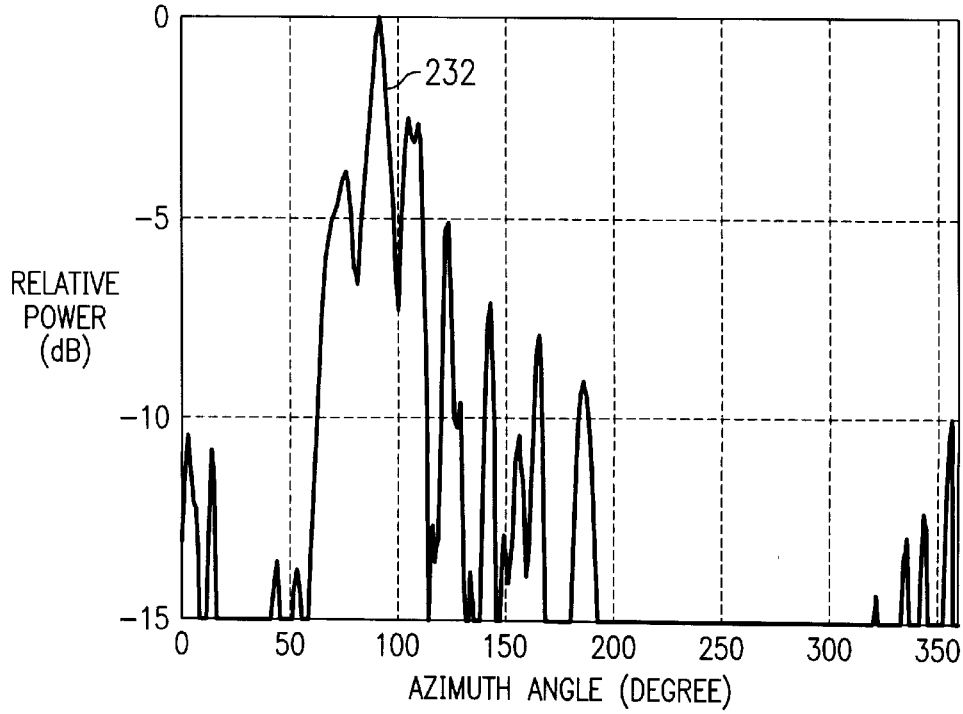
FIG. 7 graphs a relatively narrow reverse link (receive) beam pattern formed by the clustered adaptive array including medial receive elements shown in FIG. 3, focused at a direction of 90°.

FIG. 6 depicts a narrow reverse link antenna beam pattern that can be formed using the array 150 with the three medial receive elements 201, 203 and 205. In FIG. 6, a main lobe 230 has a narrow beam width from 0 dB to −5 dB and becomes somewhat broader at −5 dB. The pattern of FIG. 6 is shown directed to 180°. FIG. 7 shows a beam pattern having a main lobe 232 directed to 90° which can be formed using the adaptive antenna array 150 with the three medial receive elements 201, 203 and 205. The beam pattern shown in FIG. 7 is very similar the pattern achieved in the 180° direction shown in FIG. 6.

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as fall within the true spirit and scope of this invention.

What is claimed is:

1. A base station clustered adaptive antenna array comprising:

a plurality of clusters of antenna elements, wherein each cluster of the plurality is separated from an adjacent cluster of the plurality of clusters by a first predetermined spacing related to receive-mode beamforming, and wherein each cluster comprises a plurality of transmit-receive antenna elements, each transmit-receive antenna element spaced away from an adjacent element of the plurality of elements by a second predetermined spacing related to transmit-mode beamforming, the second predetermined spacing being less than the first predetermined spacing.

2. The clustered adaptive antenna array set forth in claim 1, wherein the first predetermined spacing is approximately ten wavelengths of a receive operating frequency range.

3. The clustered adaptive antenna array set forth in claim 1, wherein the second predetermined spacing is in a range approximately between one-half wavelength and one wavelength of a transmit operating frequency range.

4. The clustered adaptive antenna array set forth in claim 1, wherein each cluster is contained within a single radome.

5. The clustered adaptive antenna array set forth in claim 1, wherein each plurality of transmit-receive elements comprises at least four antenna elements.

6. The clustered adaptive antenna array set forth in claim 1, wherein the array is mounted to an antenna support structure having horizontal sides with a side length dimension approximately equal to the first predetermined spacing.

7. The clustered adaptive antenna array set forth in claim 6, wherein the antenna support structure is generally triangular, and wherein the antenna array comprises three clusters.

8. The clustered adaptive antenna array set forth in claim 7, wherein each cluster is mounted at a corner region of the generally triangular support structure.

9. The clustered adaptive antenna array set forth in claim 1, further comprising at least one receive antenna pod mounted between an adjacent pair of the plurality of clusters of antenna elements.

10. The clustered adaptive antenna array set forth in claim 8, further comprising three medial receive antenna pods, each said receive antenna pod being mounted to the generally triangular support structure medially between adjacent ones of the clusters of antenna elements and generally within a horizontal plane including the clusters.

11. An adaptive beam-forming receive-transmit antenna array mounted on a support tower, comprising:

a plurality of clusters, each cluster having a plurality of receive-transmit antenna elements, each antenna element separated by approximately one half wavelength to one wavelength of a transmit operating frequency range, wherein each cluster is separated from an adjacent cluster of the plurality of clusters by approximately ten wavelengths of a receive operating frequency range.

12. The adaptive beam-forming receive-transmit antenna array set forth in claim 11, wherein the antenna array comprises three clusters.

13. The adaptive beam-forming receive-transmit antenna array set forth in claim 12, further comprising three antenna pods mounted one each to a support structure between an adjacent pair of the plurality of clusters of antenna elements of the three clusters, each pod including a single receive antenna element.

14. The adaptive beam-forming receive-transmit antenna array set forth in claim 13, wherein the three receive-only antenna pods are adjustable along the support structure in order to obtain a desired spacing between the adjacent pairs of the three clusters of antenna elements.

15. The adaptive beam-forming receive-transmit antenna array set forth in claim 13, wherein a receive function of a receive-transmit antenna element of a cluster is provided by a single receive antenna element of an adjacent antenna pod.

16. The adaptive beam-forming receive-transmit antenna array set forth in claim 11, wherein each cluster comprises four antenna elements.

17. The adaptive beam-forming receive-transmit antenna array set forth in claim 16, wherein each antenna element is positionally adjustable relative to an adjacent antenna element in order to establish the element spacing.

18. The adaptive beam-forming receive-transmit antenna array set forth in claim 11, wherein each cluster is positionally adjustable relative to a center of the support tower to establish the cluster spacing.

19. The adaptive beam-forming receive-transmit antenna array set forth in claim 11, further comprising at least one receive antenna pod mounted to a support structure between an adjacent pair of the plurality of clusters of antenna elements, each of the at least one receive antenna pods comprising a single receive-only antenna element.

20. The adaptive beam-forming receive-transmit antenna array set forth in claim 19, wherein the at least one receive antenna pod is adjustable along the support structure in order to obtain a desired spacing between the adjacent pair of the plurality of clusters of antenna elements.

* * * * *